United States Patent [19]

Yung et al.

[11] Patent Number: 4,462,696

[45] Date of Patent: Jul. 31, 1984

[54] ELECTRONIC WATCHES

[75] Inventors: Tak-Yim Yung; David Citrin, both of Hong Kong, Hong Kong

[73] Assignee: United Agencies Limited, Hong Kong

[21] Appl. No.: 515,882

[22] Filed: Jul. 20, 1983

Related U.S. Application Data

[63] Continuation of Ser. No. 213,809, Dec. 8, 1980, abandoned.

[51] Int. Cl.[3] ..... G04C 19/00

[52] U.S. Cl. ..... 368/84; 368/88; 368/204

[58] Field of Search ..... 368/84, 87, 88, 204, 368/255; 84/DIG. 24

[56] References Cited

U.S. PATENT DOCUMENTS

| | | | |
|---|---|---|---|
| 4,268,913 | 5/1981 | Nakagiri et al. | 368/84 |
| 4,271,498 | 6/1981 | Zafferri et al. | 368/250 |
| 4,276,627 | 6/1981 | Komiyama | 368/88 |

*Primary Examiner*—Forester W. Isen

*Attorney, Agent, or Firm*—Townsend and Townsend

[57] ABSTRACT

A thin electronic watch is provided in which a battery for powering the watch is positioned to underlie one edge of the liquid crystal display which gives the visible time output. In this way the battery can be of sufficient capacity to give a satisfactory life even when a sound alarm is provided and optionally also a back light for the display. The display has also the edge overlapped by the battery a central region devoid of electrical contacts so as to prevent the battery from interfering with these electrical connections to the display. To give a sound alarm the glass front of the watch is used as a loudspeaker and is mechanically linked to a piezo-electric crystal which is bonded to a substrate. Then by applying an oscillating electrical signal across the piezo-electric crystal this will be caused to flex and the resulting movement transmitted to the glass front.

The thickness of watch of the invention can also be reduced by providing an opening in the circuit board and mounting the integrated circuit chip in that opening in the plane of the board. Further a reliable and thin fastening for the rear of the watch casing can be provided by fixing the rear to the casing by small screws.

8 Claims, 9 Drawing Figures

ELECTRONIC WATCHES

This is a continuation of application Ser. No. 213,809, filed Dec. 8, 1980, now abandoned.

This invention relates to electronic watches and in particular electronic watches which are very thin.

BACKGROUND TO THE INVENTION

Whilst electronic watches are widely available, they have tended to be of relatively thick construction, that is thick in the sense measured outwardly from the wrist of a user when the watch is worn as a wrist watch. There are a number of reasons for this and one of the main reasons has been the size of the battery. Thus, whilst very small batteries are known, the smaller the battery the lower the energy stored and so there is a limit to the minimum size of a battery which can give enough energy to operate the watch correctly for reasonable lengths of time.

The problem is exacerbated when the display of the watch requires illumination for night time viewing, e.g. by means of a small micro-lamp, and/or when a sound alarm function is provided. Thus, whilst the electronic circuits themselves and a liquid crystal display have minute power requirements, a back light for the illumination of such a display and/or a sound alarm represent a considerable drain on the battery resources when they are operated.

In the quest to make electronic watches thinner, different battery designs have been adopted but it has been found that a limit has been reached where, to achieve thinness of the watch, a very thin battery is available but of a relatively large diameter. The result is that there is a conflict between the diameter of the battery and the overall size or width of the display. Making the battery of smaller diameter reduces its life and making the display of smaller size may limit the appeal of the watch since one might have a relatively large diameter casing in which is a relatively small display.

Many electronic watches are provided with some form of alarm sound output and this can be achieved by means of a small buzzer or loudspeaker. However, such items are of relatively thick construction and so again could limit the overall thickness of the watch. Alternatively if the buzzer or loudspeaker is sufficiently small the space it takes up may force one to use a smaller battery or display, neither of which is desirable.

The invention has therefore been made with these points in mind and it is an object of the invention to provide a thin electronic watch or a thin watch module to be contained within an outer watch casing.

BRIEF SUMMARY OF THE INVENTION

According to the invention in one aspect, there is provided an electronic watch comprising an outer casing containing a watch module comprising a liquid crystal display to provide visual time output, that display having contacts for connecting various display segments to contacts on a circuit board positioned beneath the display, an integrated circuit chip for controlling the operation of the display and other watch functions and arranged to receive a constant frequency oscillating signal from a crystal oscillator, a battery for powering the watch, the battery being of a diameter such that it is positioned to underlie one edge of the liquid crystal display, a region along that edge of the display being devoid of the electrical contacts for connecting the various display segments of the watch display to the electronic circuitry so that the overlap between the battery and the display does not interfere with the electrical connections to the display, and a sound alarm which includes a piezoelectric crystal bonded to a substrate and means to apply an oscillating electrical signal across the crystal, the crystal being mechanically linked to the glass front so as to provide an audible alarm when the signal is applied to the crystal.

As can be seen, such a watch combines features which enable one to make the watch thinner. Thus, for example, the overlap between the battery and one edge of the display enables the battery to be of large enough diameter to have sufficient capacity to provide a reasonable length of life even when an illuminating back light is provided for the display and/or a sound alarm function are provided without the display having to be made too small.

The piezo-electric crystal provided in contact with the front glass of the watch can be thinner than a buzzer or loudspeaker. Thus, the front glass is sufficiently thin to act as a sound generator or transducer, i.e. the equivalent of the loudspeaker cone in a loudspeaker. Then, by applying an appropriate electrical oscillating signal across the piezo-electric crystal, the resulting contraction and expansion of the crystal relative its substrate will cause the crystal and bonded substrate to flex in a manner akin to a bi-metallic strip and the resulting flexing will be transmitted to the front glass of the watch so as in turn to drive the glass as a sound emitter. In this way, it is possible to provide a thin alarm sound device without problems associated with the use of a separate buzzer.

It is frequently the case that one manufacturer will make the watch casings whilst another manufacturer will make the watch module which contains the working parts of the watch and which can be positioned within one of a large number of possible outer casings. The watch module itself can be made thinner by following the concepts of the present invention and therefore according to a further aspect of the invention, there is provided a watch module comprising a liquid crystal display to provide visual time output, that display having contacts for connecting various display segments to contacts on a circuit board positioned beneath the display, an integrated circuit chip for controlling the operation of the display and other watch functions and arranged to receive a contact frequency oscillating signal from a crystal oscillator, a battery for the watch, the battery being of a diameter such that it is positioned to underlie one edge of the liquid crystal display, a region along that edge of the display being devoid of the electrical contacts for connecting the various display segments of the watch display to the electronic circuitry so that the overlap between the battery and the display does not interfere with the electrical operation of the display, and a sound alarm which includes a piezo-electric crystal bonded to a substrate and means to apply an oscillating electrical signal across the crystal, the crystal being mechanically linked to the glass front so as to provide an audible alarm when the signal is applied to the crystal.

In order to set and adjust the watch circuitry, operate the back illuminating light for the liquid crystal display and so on, a number of electrical switches are required. In conventional watches, the casing is provided with a number of push button switches slidably mounted in the side of the casing provided with their own springs so that, when they are depressed, they move against the action of their own compression spring and contact the appropriate one of a number of switch contacts on the watch module, so closing that contact against another contact to complete the appropriate electrical circuit. The overall size of such push buttons however would limit the minimum overall thickness of the watch since a push button containing its own internal compression spring has a minimum practical size for reasonably simple, cheap and reliable construction.

In a watch according to the invention, this problem is overcome by mounting the push buttons so that they are freely slidable within the watch casing and by making the switch contact resilient and of a resilience such that it acts as a spring and returns the push button to its normal rest position when the button is released. In this way, the push buttons can be made very small and the resiliency required to restore the push buttons to their non-operating position is provided by the switch contacts themselves.

The watch casing will preferably have a removable back. In order to keep the casing thin, the back will also preferably be rather thin. Therefore, although the back could be a snap fit or screw fit into the casing the reliability of attachment of the back to the casing may not be good since the back may flex and readily come free. Therefore according to a preferred embodiment of the invention the back is attached to the casing by screws. Thus a number of tapped screw holes may be provided in the casing and a number of holes are provided through the back in lugs extending from the back and aligned with the tapped holes in the casing so that screws secured in the tapped holes and passing through the holes in the back will secure the latter to the casing.

In order to save further space, an opening is preferably provided through the circuit board and the integrated circuit chip is mounted in that opening in the plane of the board. This can save the thickness of the chip as compared with mounting the chip above the circuit board sandwiched between the board and the display.

BRIEF DESCRIPTION OF THE DRAWINGS

An example of a very thin electronic watch according to the invention will now be described with reference to the accompanying drawings, in which.

DESCRIPTION OF THE PREFERRED EMBODIMENT

Figure 1:
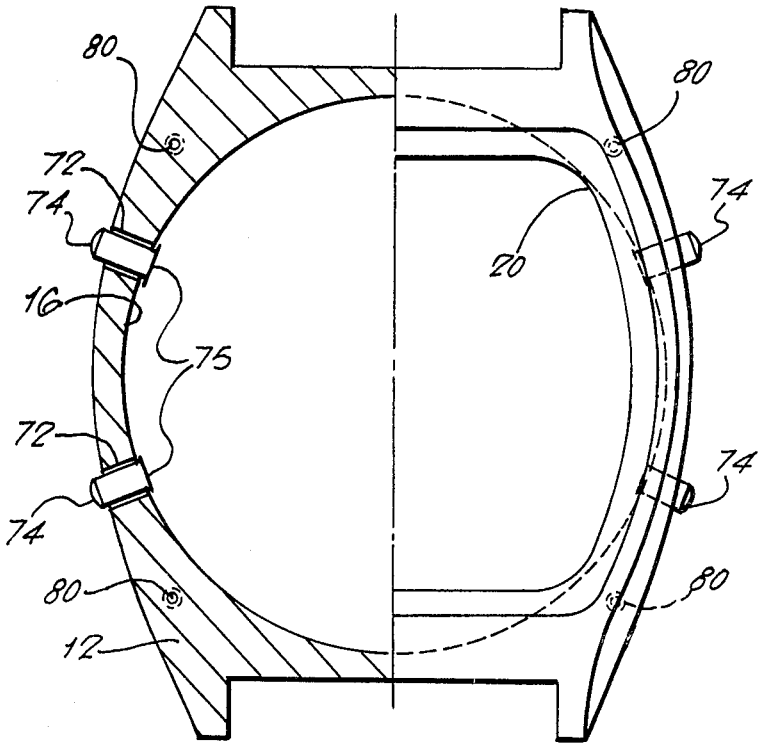
FIG. 1 is a half plan-half section through the casing of a watch according to the invention.

The watch 10 shown in the drawings includes an outer casing 12 having a removable back 14. Within a central cavity 16 in the casing 12 is provided a watch module 18.

Figure 8:
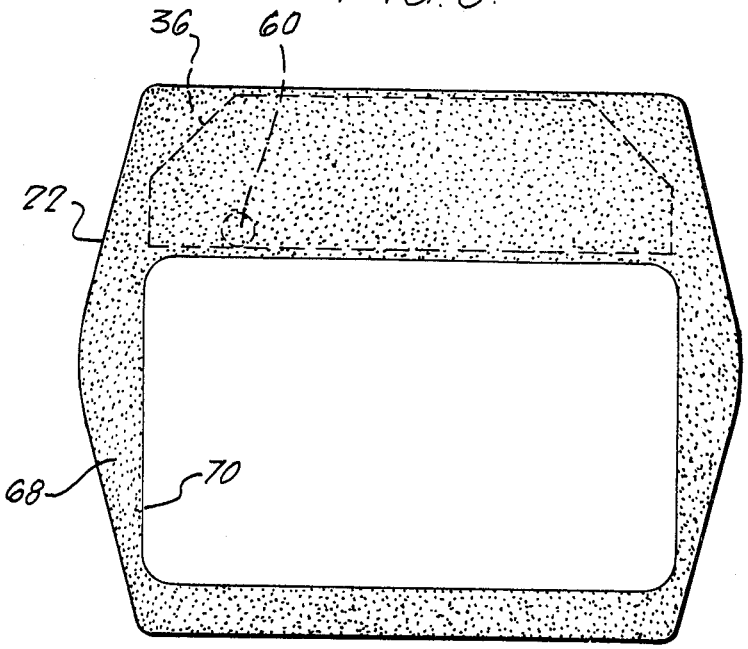
FIG. 8 is an underplan view of the glass front for the watch.

As best shown in FIG. 1, the casing has a central opening 20 as viewed from above, i.e. the right-hand side of FIG. 1, and closing that opening is a glass front 22 shown in FIG. 8. The glass is very thin so that, as explained above, it can act as a sound transducer.

Figure 6:
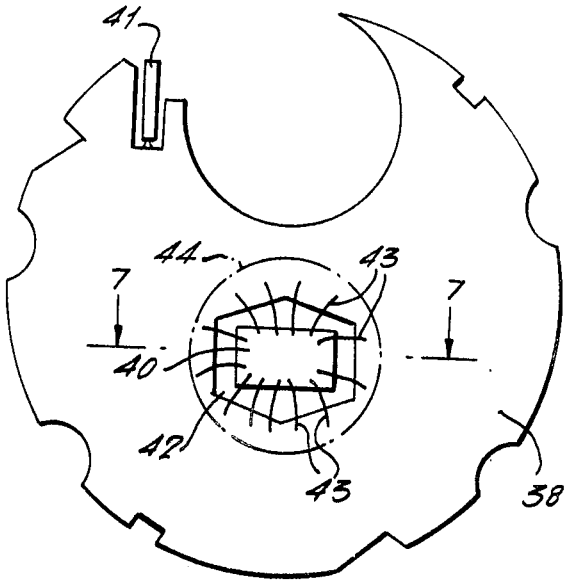
FIG. 6 is a plan detail showing the circuit board and the integrated circuit chip.

The watch module 18 comprises a body 30 moulded from synthetic plastics material and this body houses a generally rectangular liquid crystal display 32, a thin circular battery 34, a piezo-electric crystal 36, a printed circuit board 38, an integrated circuit chip 40 and a crystal oscillator 41 (see FIG. 6). In order to save space, the printed circuit board, see FIG. 6, has an opening 42 and the integrated circuit chip 40 is mounted within that opening in the general plane of the board. It is joined by gold wires 43 in conventional fashion to electrical contacts on the circuit board 38 around the opening. For protection, the chip 40 and wires 43 are embedded in an epoxy coating 44 and a die plate 45 is glued to the underside of the board and supports the chip 40. The contact of the chip with the board, the electrical conductors and other components mounted on the circuit board 38 are not shown in detail and will not be described in detail since they are entirely conventional.

The liquid crystal display has a large number of individual segments arranged so that a digital display of time, date, etc. can be provided. These segments, their arrangements and their construction are entirely conventional and again will not be described in detail. As with conventional liquid crystal displays, each segment is joined to an individual electrical contact and in the display 32, these contacts 46 are arranged so as to be spaced from one another along the two longer sides 47 and 48 of the rectangular display. The contacts 46 are electrically connected to associated contacts on the printed circuit board 38 in a conventional manner by means of strips of elastomeric connectors formed of alternating thin laminations of conductive and insulating silicone rubber. This is entirely conventional.

Figure 3:
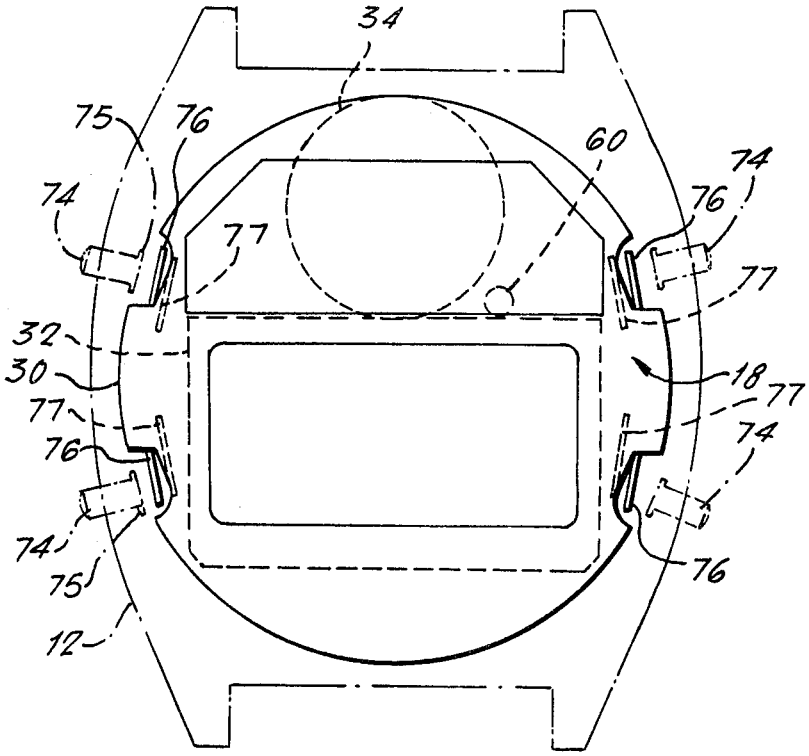
FIG. 3 is a plan view of a watch module according to the invention shown positioned within a watch casing shown in broken lines.
Figure 5:
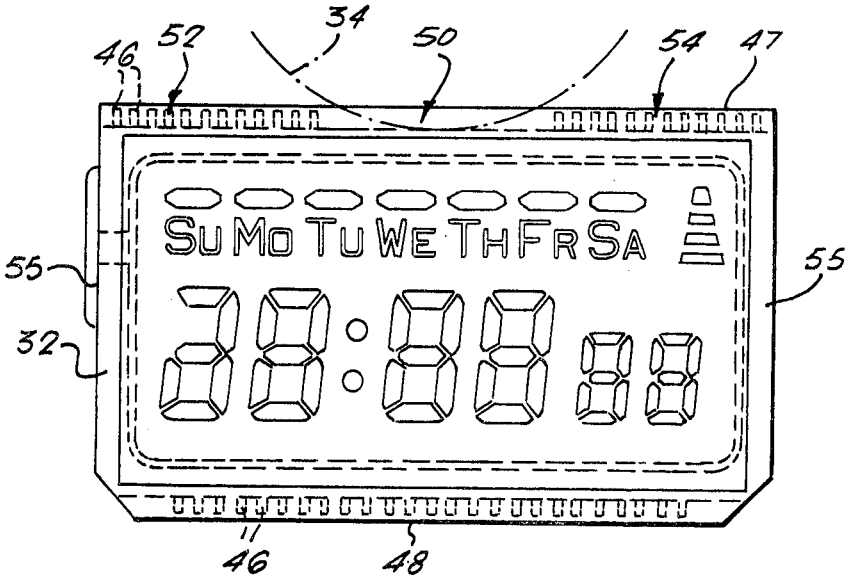
FIG. 5 is an enlarged plan view of a liquid crystal display used in the watch.
Figure 9:
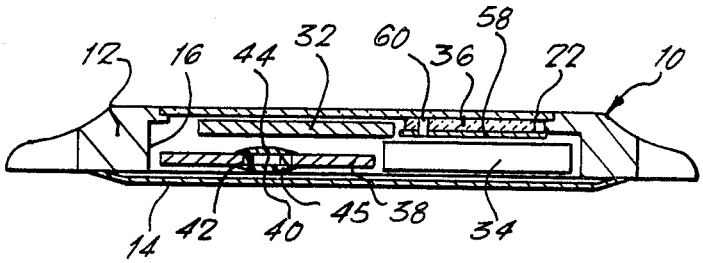
FIG. 9 is a section through the watch showing the arrangement of various key components within the watch casing.

Because the watch 10 is intended to be very thin, the battery 34 is of necessity of a relatively large diameter but very thin construction. In addition, the display 32 for attractiveness needs to be of a relatively large size. Therefore, as best shown in FIGS. 3, 5 and 9, one edge of the display 32 overlaps an edge portion of the battery. The edge of the display which overlaps with the battery is one of the longer edges 47 of the display. As best shown in FIG. 5, this would of course result in difficulties in making electrical contact with contacts in a central region 50 along that edge. Instead, therefore, the contacts 46 along the edge 47 are positioned in two groups in regions 52 and 54 which are adjacent the shorter edges 55 of the rectangular display. As a result, the central region 50 along that edge is devoid of electrical contacts and so this avoids any problem of conflict between the edge of the battery 34 and the making of electrical connection to the contacts 46.

As best shown in FIG. 8, the glass panel has an opaque electrically conductive covering 68 and a central transparent opening 70 through which the portions of the display 32 which generate the visible digital output can be viewed. The opaque covering 68 masks other portions of the display such as the contacts 48 and also acts as one electrode for energizing the crystal 36 in the manner described below.

To produce an alarm sound output the piezo-electric crystal 36 is provided. One face is bonded to a metal substrate 58 and the other face is in mechanical contact with the underside of the glass front 22. Through an opening 60 in the crystal, an electrically conductive spring (not shown) passes up from the board 38 into contact with the covering 68. When an alarm sound is to be generated, an oscillating electrical signal is applied to the crystal 36 by the electronic circuitry between the covering 68 and the substrate 37. As a result the crystal is caused alternately to expand and contact and since the substrate 58 does not change, the crystal and substrate bow alternately one way and then the other. Thus the crystal converts the electrical oscillations to mechanical vibrations which are transmitted to the glass 22 by contact which then gives the required sound output.

Through the sidewall of the casing are a number of small holes 72 and slidably mounted within these are small push buttons 74. The push buttons 74 are free to move inwardly and outwardly relative the casing except that at their inner ends, they have outwardly projecting flanges 75 to prevent their complete removal from the casing in the outward direction. No spring is provided between the push buttons 74 and the casing.

Figure 4:
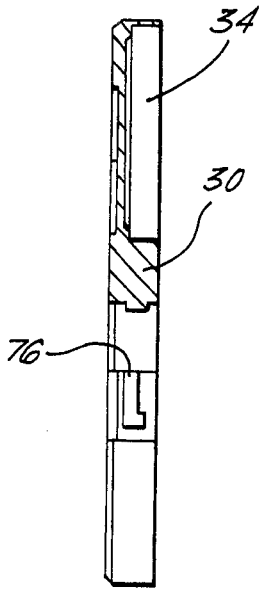
FIG. 4 is a half side view-half section through the watch module shown in FIG. 3.
Figure 7:
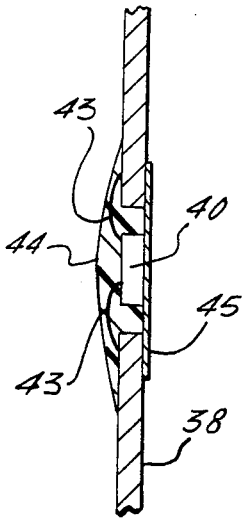
FIG. 7 is an enlarged sectional detail taken on the lines 7—7 of FIG. 6.

Mounted on the circuit board 38 are a number of switches which include resilient movable contacts 76 (see FIGS. 3 and 4) and stationary contacts 77. The inner ends of the push buttons 74 are aligned with a respective switch contacts 76 so that when a push button 74 is depressed, it will contact its associated movable contacts 76 and then push that against its inherent resilience into electrical engagement with the associated stationary contact 77 and so complete an electric circuit. The completion of the circuit can be used to set and adjust the time display, to illuminate the display 36 from behind by means of a small lamp, not shown, and to set the alarm. These operations are entirely conventional and so will not be described further. Once a push button 74 is released, the inherent resiliency of the movable contact 76 restores the push button to its outward position and so breaks the electrical continuity with the stationary contact 77.

Figure 2:
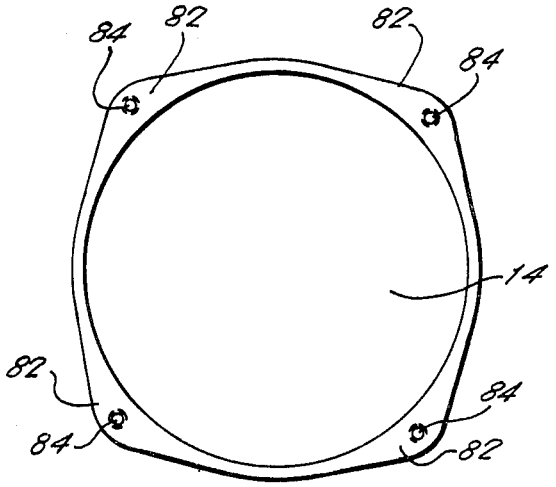
FIG. 2 is a view from the rear of the removable back to the watch casing shown in FIG. 1.

Referring now to FIGS. 1 and 2, the back 14 is not itself provided with a screw thread by means of which it is attached to the back of the casing. Instead, the casing 12 has four tapped holes 80 whilst the back 14 has outwardly projecting lugs 82 in which are provided holes 84. Small screws, not shown, are then used to attach the back 14 to the casing so that the back is removable when access is required to the cavity 16, for example, to replace a battery 34. However, the attachment of the back 14 to the casing 12 in this way provides a thinner construction than if the back itself were screwed in to the casing 12.

A latitude of modification, change and substitution is intended in the foregoing disclosure and in some instances some features of the invention will be employed without corresponding use of other features. Accordingly, it is appropriate that the appended claims be construed broadly and in a manner consistent with the spirit and scope of the invention herein.

I claim:

1. An electronic watch comprising:

an outer casing, a glass front for said casing, a substantially rectangular liquid crystal display visible through said glass front and having an opposed pair of longer edges and an opposed pair of shorter edges, electrical contacts positioned on the rear face of said display, adjacent one of said longer edges for the entire length thereof and adjacent the other of said longer edges for portions of the length thereof towards each end thereof, leaving a contact-free region along a central portion of said other longer edge, a circuit board positioned behind said display, means for connecting said contacts of said display to said circuit board, a crystal oscillator for providing a constant frequency oscillating signal, an integrated circuit chip for controlling the operation of said display and other watch functions and receiving said constant frequency oscillating signal from said crystal oscillator, a thin circular battery for powering said watch, said battery positioned behind and parallel to said display and adjacent to said circuit board, the region of overlap between said battery and said display lying entirely within said contact-free region on said rear display face, a piezo-electric crystal, a substrate to which said crystal is bonded, means for applying an oscillating electrical signal across said crystal, and means mechanically linking said glass front to said crystal to provide an audible alarm when said signal is applied to said crystal.

2. A watch according to claim 1 and further comprising an opening in said circuit board, said integrated circuit chip being mounted within said opening in the plane of said board.

3. A watch according to claim 1 further comprising at least one set of switch contacts mounted on said circuit board, each of said sets comprising a fixed contact and a resilient movable contact, and at least one push button slidably mounted on said casing, said button upon manual depression contacting its associated movable contact and moving it into contact with its associated fixed contact against the resiliency of said movable contact, the button being restored to its mutual position by the resiliency of the said movable contact once the button is released.

4. A watch according to claim 1 and further comprising:

a removable back for said outer casing, a number of tapped screw holes in said casing, a number of holes through said back aligned with said tapped holes in said casing when said back is in position, and screws securing said back to said casing and secured in said tapped holes.

5. An electronic watch comprising:

an outer casing, a removable back for said casing, a glass front for said casing, a number of tapped screw holes in said casing, a number of holes through said back aligned with said tapped holes in said casing when said back is in position, screws securing said back to said casing and secured in said tapped holes, a substantially rectangular liquid crystal display visible through said glass front and having an opposed pair of longer edges and an opposed pair of shorter edges, electrical contacts positioned on the rear face of said display, adjacent one of said longer edges for the entire length thereof and adjacent the other of said longer edges for portions of the length thereof towards each end thereof, leaving a contact-free region along a central portion of said other longer edge, a circuit board positioned behind said display, means for connecting said contacts of said display to said circuit board, a crystal oscillator for providing a constant frequency oscillating signal, an integrated circuit chip for controlling the operation of said display and other watch functions and receiving said constant frequency oscillating signal from said crystal oscillator, a thin circular battery for powering said watch, said battery positioned behind and parallel to said display and adjacent to said circuit board, the region of overlap between said battery and said display lying entirely within said contact-free region on said rear display face, a piezo-electric crystal, a substrate to which said crystal is bonded, means for applying an oscillating electrical signal across said crystal, and means mechanically linking said glass front to said crystal to provide an audible alarm when said signal is applied to said crystal.

6. A watch module comprising:

a substantially rectangular liquid crystal display having an opposed pair of longer edges and an opposed pair of shorter edges, electrical contacts positioned on the rear face of said display, adjacent one of said longer edges for the entire length thereof and adjacent the other of said longer edges for portions of the length thereof towards each end thereof, leaving a contact-free region along a central portion of said other longer edge, a circuit board positioned behind said display, means for connecting said contacts of said display to said circuit board, a crystal oscillator for providing a constant frequency oscillating signal, an integrated circuit chip for controlling the operation of said display and other watch functions and receiving said constant frequency oscillating signal from said crystal oscillator, a thin circular battery for powering said watch, said battery positioned behind and parallel to said display and adjacent to said circuit board, the region of overlap between said battery and said display lying entirely within said contact-free region on said rear display face, a piezo-electric crystal, a substrate to which said crystal is bonded, means for applying an oscillating electrical signal across said crystal, and means mechanically linking said crystal to a glass front for a watch to provide an audible alarm.

7. A watch module according to claim 6 further comprising at least one set of switch contacts mounted on said circuit board, each of said sets comprising a fixed contact and a resilient movable contact.

8. A watch module according to claim 6 and further comprising an opening in said circuit board, said integrated circuit chip being mounted within said opening in the plane of said board.

* * * * *